US006467532B1

(12) United States Patent
Andersen et al.

(10) Patent No.: US 6,467,532 B1
(45) Date of Patent: Oct. 22, 2002

(54) METHOD AND APPARATUS FOR COUNTER-GRAVITY CASTING OF METAL

(75) Inventors: Henrik Klarskov Andersen, Albertslund (DK); Kaj J. Jensen, Lyngby (DK); Henning Larsen, Søborg (DK)

(73) Assignee: Georg Fischer Disa A/S, Herlev (DK)

( * ) Notice: Subject to any disclaimer, the term of this patent is extended or adjusted under 35 U.S.C. 154(b) by 0 days.

(21) Appl. No.: 09/719,769

(22) PCT Filed: Jul. 6, 1998

(86) PCT No.: PCT/DK98/00310

§ 371 (c)(1),
(2), (4) Date: Dec. 18, 2000

(87) PCT Pub. No.: WO00/01503

PCT Pub. Date: Jan. 13, 2000

(51) Int. Cl.[7] ..... B22D 46/00; B22D 17/32; B22D 5/00; B22C 19/04

(52) U.S. Cl. ..... 164/457; 164/155.1; 164/155.3; 164/155.2; 164/155.6; 164/284; 164/323

(58) Field of Search ..... 164/457, 4.1, 151, 164/151.1–151.3

(56) References Cited

U.S. PATENT DOCUMENTS 3,425,483 A 2/1969 Dearth
3,844,331 A * 10/1974 Py et al. ..... 164/4
4,227,565 A * 10/1980 Lavanchy et al. ..... 164/155
4,289,946 A * 9/1981 Yarwood et al. ..... 164/503
4,585,050 A * 4/1986 Merrien et al. ..... 164/457
4,714,102 A 12/1987 Koya
4,860,820 A * 8/1989 Pereira ..... 164/457
5,215,141 A * 6/1993 Kuhn et al. ..... 164/457

FOREIGN PATENT DOCUMENTS

FR 2 460 170 1/1981

OTHER PUBLICATIONS

Pat. Abst. Of JP, abstract of JP 62–207562 A (Enbishi Arumihoiile KK), Sep. 11, 1987.
Pat. Abst. Of JP, abstract of JP, vol. 10, No. 326; Nov. 6, 1986; JP 61132258; Sintokogio Ltd.

* cited by examiner

*Primary Examiner*—M. Alexandra Elve
*Assistant Examiner*—Kevin McHenry
(74) *Attorney, Agent, or Firm*—Larson & Taylor PLC

(57) ABSTRACT

When casting e.g. aluminium alloy in a mould (2), that may be one of a string of moulds extending at right angles to the plane of the drawing, the pressure used for filling the mould (2) against gravity by a pressurizing device (4) is controlled according to a predetermined pressure/time programme having previously been read into a control unit (22), e.g. a digital computer, at least one of a number of sensors sensing pressure (8), levels (9,10) and full level (11) being used to supply inputs to the control unit (22). Sensors are chosen according to need for each particular casting programme.

16 Claims, 4 Drawing Sheets

METHOD AND APPARATUS FOR COUNTER-GRAVITY CASTING OF METAL

TECHNICAL FIELD

The present invention relates to a method of casting metal products by transferring molten metal from a furnace into a casting cavity at a higher level by means of a pressurizing device capable of creating in the molten metal a pressure sufficient to lift it to said higher level. Similar methods have been disclosed in a number of publications, but none of them provides any practical guidance with regard to achieving a filling of the casting cavity as quickly as possible and at the same time avoiding undue turbulence and shock, such as when the surface of the molten metal hits the top wall of the casting cavity.

DISCLOSURE OF THE INVENTION

It is the object of the present invention to provide a method with which it is possible to fill the casting cavities concerned as quickly as possible whilst avoiding undue turbulence and shock. By, in this manner, controlling the action of the pressurizing device on the basis of one or more parameters relating to the flow of the molten metal into the casting cavity, it is possible to achieve a "mould-filling profile", i.e. the level of molten metal in the mould as a function of time, corresponding to optimum filling conditions, e.g. first filling the major part of the casting cavity at a relatively high pressure, but not so high as to cause undue turbulence, and then reducing the pressure to achieve a gentle and shock-free filling of the top of the casting cavity.

The present invention also relates to an apparatus for carrying out the method according to the invention.

Advantageous embodiments of the method and the apparatus, as well as the effects thereof—beyond what is obvious—are explained in the following detailed part of the present description.

BRIEF DESCRIPTION OF THE DRAWINGS

In the following detailed part of the present description, the invention will be described in more detail with reference to the exemplary embodiment of an apparatus according to the invention shown diagrammatically in the drawings, in which.

DESCRIPTION OF THE PREFERRED EMBODIMENTS

Figure 1:
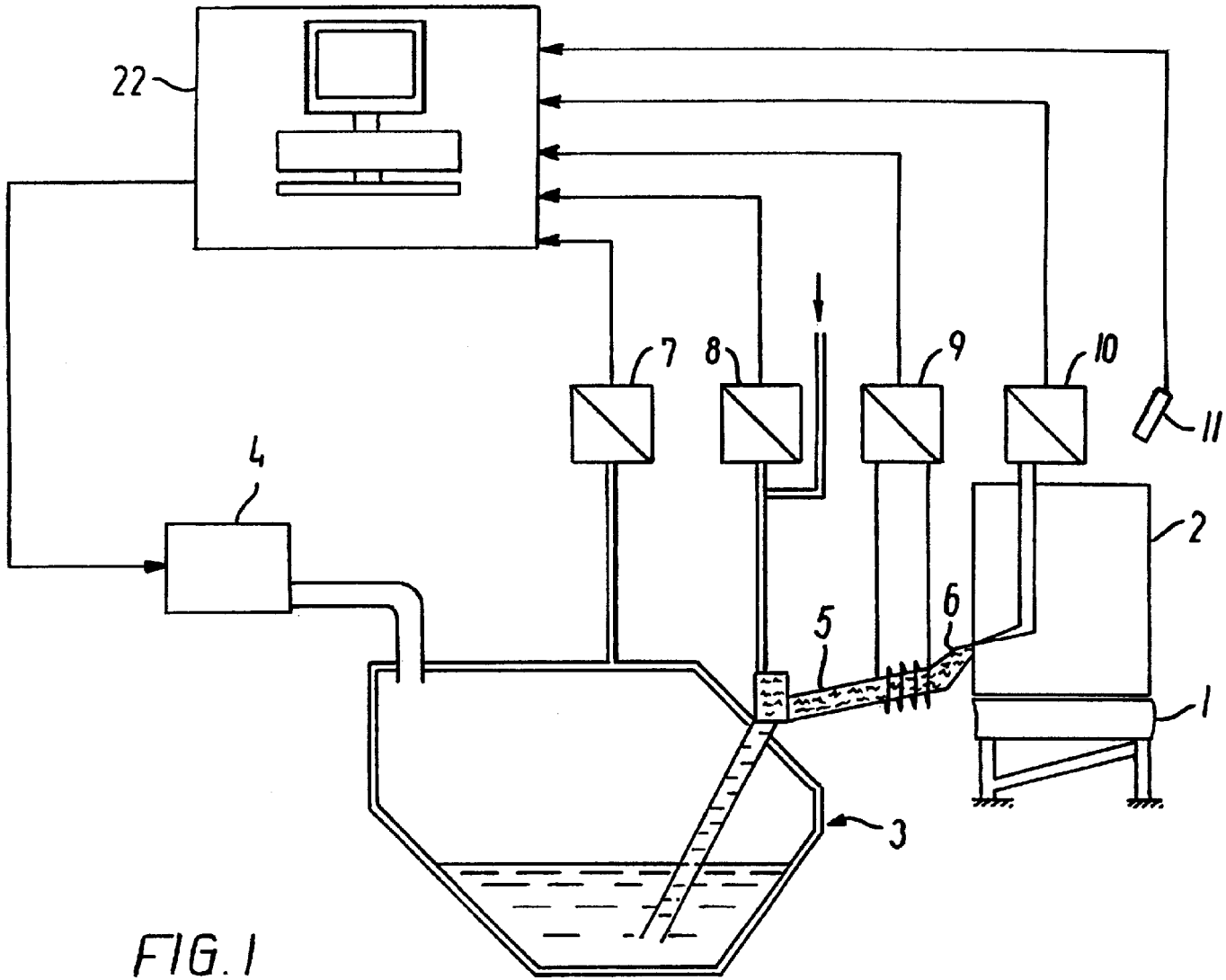
FIGS. 1 and 2 are overall views of two exemplary embodiments of a mould-filling station comprising an apparatus according to the invention comprising several sensing functions.

The mould-filling station shown in FIG. 1 comprises as its main operational components

- a mould support 1, in the exemplary embodiment shown being adapted to support a string of
- moulds 2, said string extending at a right angle to the plane of the drawing,

- a supply of molten metal contained in a substantially closed furnace 3,
- a gas-supply unit 4 adapted to apply a suitably controlled gas pressure to the space inside the furnace 3 so as to cause molten metal to flow through
- a filling tube 5 extending upwardly to
- a mouthpiece 6 adapted for temporary connection to the mould 2 being in a position for filling on the support 1.

In addition to the operational components listed above, the mould-filling station shown in FIG. 1 comprises various sensing and control components, viz.

- a first pressure sensor 7 adapted to measure the pressure inside the furnace 3,
- a second pressure sensor 8 adapted to measure the pressure in the filling tube 5,
- a melt-level sensor 9 adapted for inductively sensing the presence or absence of melt in the filling tube 5 at a level lower than that of the mouthpiece 6,
- a lower filling sensor 10 adapted for sensing the presence or absence of melt in the mouthpiece 6 immediately upstream of its connection to the mould 2,
- an upper filling sensor 11 adapted to sense melt having reached a position in or close to an opening (not shown) in the top of the mould 2, and
- a main control unit 22 adapted to receive and process signals from the sensors 7–11, and, on the basis of such processed signals, to send a control signal to the gas-supply unit 4.

At this point it should be emphasized that the sensors 7–11 need not always all be in operation in each and every mould-filling process, the choice of which of them to use being based upon circumstances in each particular case.

In addition to the sensors described above or in place of some of them, the mould-filling station could also comprise the following sensors or sensing functions, none of which are shown in FIG. 1:

- level sensing based upon electrical capacity measurements in the mould 2, the ascending melt constituting one electrode, the other electrode being a conductor embedded in the mould close to the casting cavity,
- level sensing using electrodes in or facing the casting cavity in the mould 2 and being short-circuited upon the melt having ascended to a particular level,
- electromagnetic flow sensing,
- flow sensing of the Venturi type.

The use of any one or any of these additional functions will, of course, enter into the choice of sensors referred to previously.

The various sensing functions and their use in the present connection, i.e. controlling the flow of melt into the mould, will now be described.

The first pressure sensor 7 will measure the gas pressure in the furnace 3 and send a corresponding signal to the main control unit 22, enabling the latter to compare the actual gas pressure in the furnace to the pressure specified in the programme to exist at any given moment.

The second pressure sensor 8 will measure the metallostatic pressure at the inlet to the filling tube 5, this pressure giving an indication of the level reached by the free surface of the melt. If this level differs from that according to the mould-filling programme as previously stored in the main control unit 22, this unit will signal to the gas-supply unit 4 to effect the requisite increase or decrease in the pressure inside the furnace 3, thus causing a corresponding rise or fall in the level of the free surface of the melt.

The melt-level sensor 9 operates on the basis of the inductance of a coil surrounding the filling tube 5, the value of this inductance depending on the presence or absence of melt in the tube 5 at that particular point. Thus, the signal from the sensor 9 is substantially a YES/NO signal that can be used, either as a "CLEAR" signal for the actual filling of the mould to begin, or as a corrective to modify the mould-filling programme according to whether the point in time, at which the signal changes from NO to YES, coincides with or is early or late in relation to the point in time, at which the programme "expects" the surface of the melt to arrive at this sensor.

The lower filling sensor 10 will, of course, signal the arrival of the free surface of the melt at the inlet to the mould 2, while the upper filling sensor 11 will signal the arrival of said surface in the top of the mould, thus indicating that the latter has been filled. Like the signal from the melt-level sensor 9, the signals from the filling sensors 10 and 11 are substantially YES/NO signals, useful mainly for any necessary corrections to the mould-filling programme in the manner indicated above.

Figure 2:
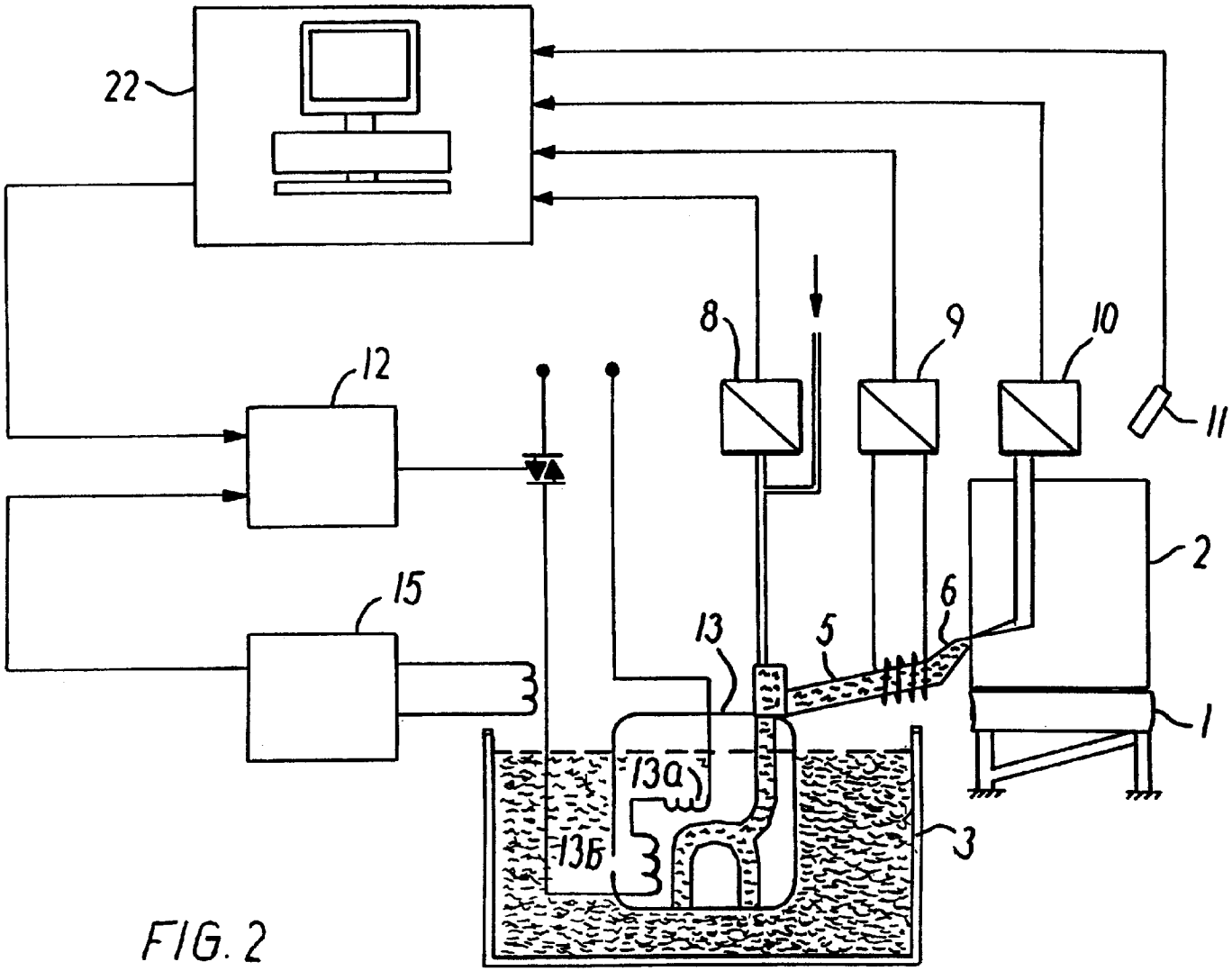

In the embodiment shown in FIG. 2, the supply of molten metal is contained in a furnace 3, that need not necessarily be closed like the one shown in FIG. 1. The requisite pressure needed to transfer the molten metal from the furnace 3 to the mould 2 through the filling tube 5 is provided by an electromagnetic pump 13, e.g. having a field coil 13*a* and a current coil 13*b*.

Instead of the first pressure sensor 7 shown in FIG. 1, the embodiment shown in FIG. 2 comprises

- a current regulator 12 adapted to control the current flowing through the field coil 13*a* and current coil 13*b* in the electromagnetic pump 13, in the example shown using a double thyristor, the regulator 12 also receiving a comparison signal from
- a current sensor 15 adapted to measure the current through the coils 13*a* and 13*b*, producing said comparison signal on the basis of the value measured.

As will be understood, the current sensor 15 does not directly take part in the monitoring of the casting process as carried out by some or all of the sensors 8–11, as it is a part of the closed loop controlling the current metered by the regulator 12. This sensor may be adapted to produce an $I^2$ signal rather than an I signal, so as to represent the power input rather than the current input to the pump 13, the former being more closely related to the pump's hydraulic power output.

Of the sensing functions not shown but described above

- the capacitive level sensing could be used for continuous control of that part of the mould-filling process, during which the level of melt ascends through the casting cavity in the mould 2,
- the short-circuit level sensing could be used to provide a YES/NO signal useful for correcting the mould-filling programme,
- the electromagnetic flow sensing as well as that of the Venturi type could be used for continuous control of the part of the mould-filling process referred to above.

Figure 3:
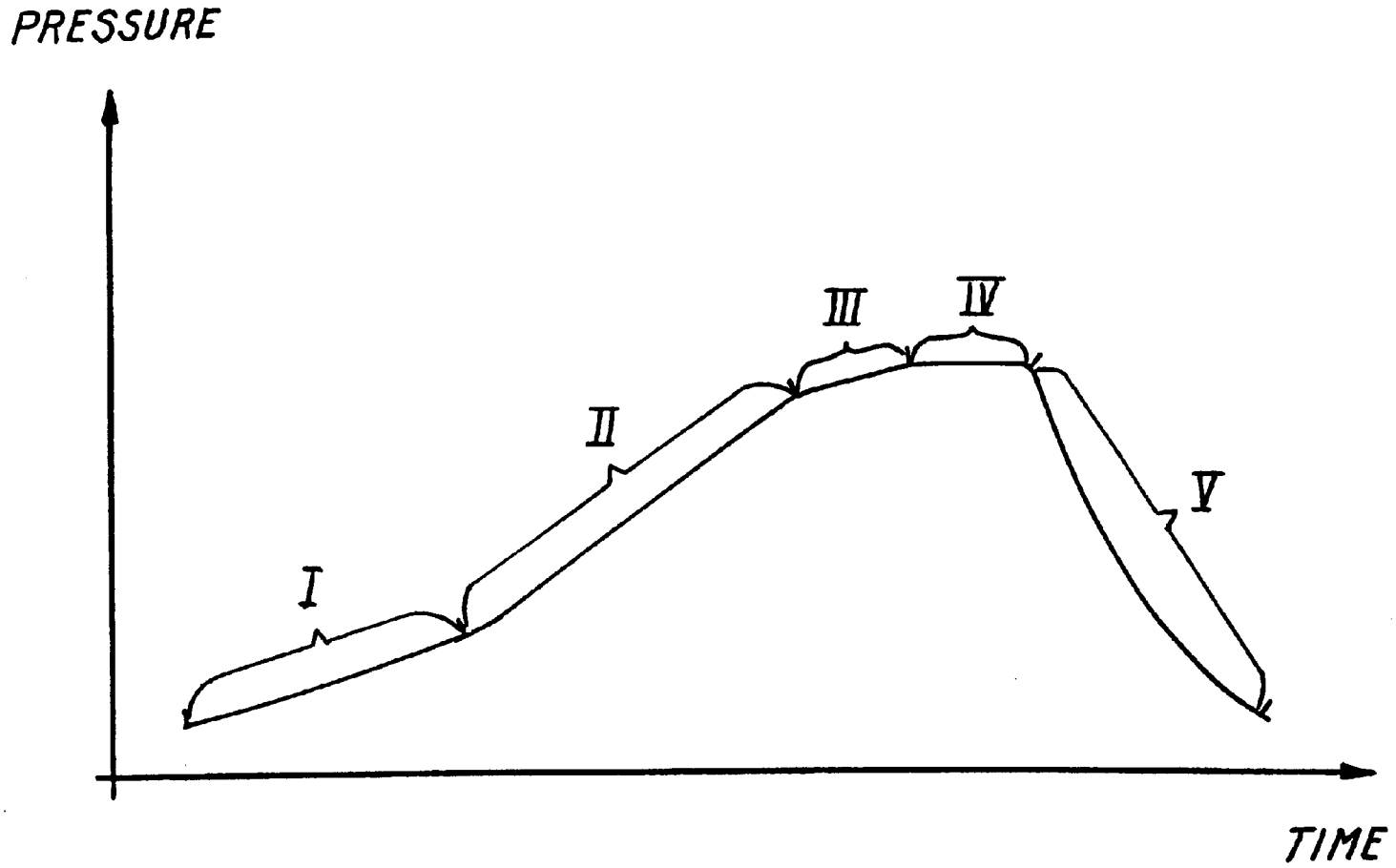
FIG. 3 is a graph showing an example of a mould-filling profile shown in the form of pressure as a function of time.

The programme installed in the main control unit 22—preferably a digital computer of the type used for controlling industrial processes—could be divided into five steps, cf. FIG. 3:

I: Pre-filling pressure: mould being prepared for filling.

II: Filling pressure: programmed to fill the mould to a level slightly below the top as quickly as possible while avoiding turbulence and oscillations.

III: Holding pressure: increasing slowly to avoid melt impact to the top of the casting cavity.

IV: Closing pressure: held constant while the mould is being closed.

V: Relaxation pressure: adjusted for non-turbulent return flow of melt from the upper part of the filling tube to the furnace.

These pressures are preferably those measured by the pressure sensors 7 and/or 8 and signaled by it/them to the main control unit 22.

Figure 4:
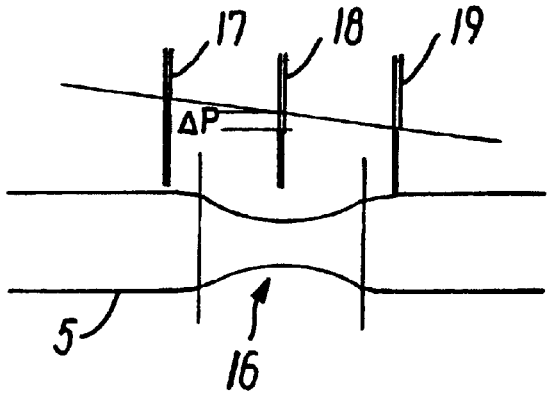
FIGS. 4–6 show various examples of sensing arrangements that can be used in the apparatus shown in FIG. 1 and/or FIG. 2.

FIG. 4 illustrates the possible use of a Venturi restriction 16 in the filling tube 5. By using three pressure gauges 17, 18 and 19 placed upstream of, within and downstream of the restriction, it is possible to compensate for the flow resistance so as to achieve a more realistic value of the true Venturi drop, and thus the flow velocity in the filling tube 5.

Figure 5:
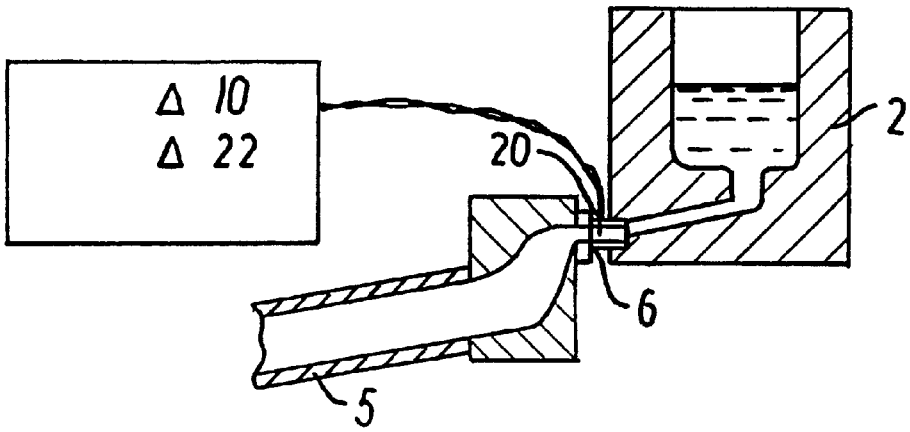

FIG. 5 illustrates the possible use of a thermocouple 20 to sense the temperature in the outlet of the mouthpiece 6. This thermocouple 20 would then constitute part of the lower filling sensor 10, signaling the arrival of the melt in the outlet of the mouthpiece 6.

Figure 6:
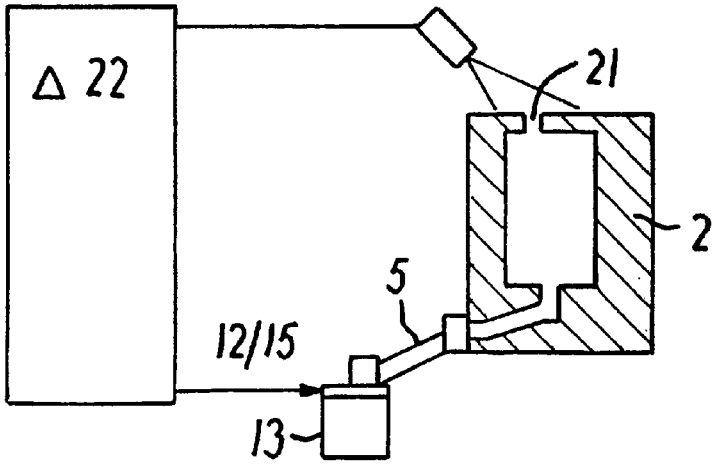

FIG. 6 illustrates how the upper filling sensor 11, in this example in the form of an infra-red sensor or camera, monitors an opening 21 in the top of the mould 2, so as to react when it "sees" the hot melt rising in this opening. By aiming a thermally sensitive sensor obliquely to the vertically extending opening as shown, the sensor senses radiation from the opening but not, or at least to a substantially lesser degree, from the mould cavity. By using a camera it is possible to achieve very accurate control of the termination of the filling process by comparing the image information transmitted by the camera to the main control unit 22 to image information having previously been read into the latter.

As indicated previously, the decision as to which sensing function or functions to include in the operation will depend on the conditions in each particular case, mainly the shape and size of the casting cavity in each mould 2, as well as the characteristics of the melt.

What is claimed is:

1. A method of casting metal products by transferring molten metal from a furnace to a presented cavity of successive casting cavities of moulds in a mould string which mould string is advanced in unison, said method comprising the steps of:

generating a predetermined profile of molten metal level in the presented cavity as a function time during filling of the presented cavity;

creating in the molten metal with a pressurizing device a pressure sufficient to lift the molten metal via a duct leading from the furnace to the presented cavity;

controlling, with a closed-loop control arrangement, the pressurizing device to vary the pressure to ensure that the presented cavity is filled with molten metal in accordance with the predetermined profile, said controlling step including the step of deriving an input for the closed-loop control arrangement from a measured flow velocity of the molten metal taken from a sensor of a Venturi restriction in the duct in order to control the pressurizing device.

2. A method of casting metal products as claimed in claim 1:

wherein the furnace includes a substantially closed chamber and the pressurizing device is a controllable gas-pressure unit which creates a variable gas pressure in the closed chamber; and wherein said controlling step further includes the step of using a second input to control the gas-pressure unit which second input is a function of power supplied to the pressurizing device.

3. A method of casting metal products as claimed in claim 2, where the second input is the power supplied to the gas-pressure unit.

4. A method of casting metal products as claimed in claim 2, where the second input is a pressure created by the gas-pressure unit in the closed chamber.

5. A method of casting metal products as claimed in claim 1:

wherein the pressurizing device is an electromagnetic pump including a means for creating an alternating or travelling electromagnetic field in the molten metal which creates a pressure differential in the molten metal; and wherein said controlling step further includes the step of using a second input to control the electromagnetic pump which second input represents power supplied to the electromagnetic pump.

6. A method of casting metal products as claimed in claim 5, where the second input is an electrical current flowing through the electromagnetic pump.

7. A method of casting metal products as claimed in claim 1:

wherein each casting cavity includes an opening at a top thereof; and wherein said controlling step further includes as a safety measure the steps of detecting an absence or presence of molten metal in the opening of the presented casting cavity, and reducing a filling velocity of the molten metal in the casting cavity to zero when the presence of molten metal is detected in the opening.

8. An apparatus for casting metal products comprising:

a furnace which contains a molten metal to be cast;

a string of moulds, each mould including a casting cavity therein;

means for advancing said string and for presenting successive moulds at a mould support where filling occurs;

a duct leading upward from the furnace and into each successively presented casting cavity;

a pressurizing device which creates in the molten metal a pressure sufficient to lift the molten metal to a higher level through said duct;

a predetermined profile of molten metal level in the presented cavity as a function time during filling of the presented cavity;

a closed-loop control arrangement which controls a power supplied to said pressurizing device to ensure that the presented cavity is filled with molten metal in accordance with the predetermined profile, said control arrangement including a Venturi restriction in said duct which creates a pressure difference indicative of a flow velocity of the molten metal in said duct, and a sensor which senses the pressure difference and which transmit a corresponding signal indicative thereof to effect control of the power.

9. An apparatus for casting metal products as claimed in claim 8:

wherein said pressurizing device is an electromagnetic pump including a means for creating an alternating or travelling electromagnetic field in the molten metal which creates a pressure differential in the molten metal; and wherein said controlling arrangement controls an electrical current supplied to said pump.

10. An apparatus for casting metal products as claimed in claim 8, further including a level sensor which senses an arrival of a surface of molten metal in said duct and which transmits a signal indicative thereof to said control arrangement.

11. An apparatus for casting metal products as claimed in claim 8, further including a level sensor which senses an arrival of a surface of molten metal at an entry into said presented mould and which transmits a signal indicative thereof to said control arrangement.

12. An apparatus for casting metal products as claimed in claim 8:

wherein each casting cavity includes an opening at a top thereof; and wherein said controlling arrangement further includes a sensor which senses thermal radiation substantially from the presented said opening rather than from the mould cavity.

13. An apparatus for casting metal products as claimed in claim 12, wherein said sensor senses radiation along a line extending obliquely from an opening direction of the opening.

14. An apparatus for casting metal products as claimed in claim 13, wherein the opening direction is vertical.

15. An apparatus for casting metal products as claimed in claim 12, wherein said sensor transmits a thermal image to said control arrangement.

16. An apparatus for casting metal products as claimed in claim 9:

wherein said control arrangement includes a digital controller which processes the signal produced by said sensor, a programme in said digital controller which incorporates said predetermined profile, which receives the signal from said sensor, and which produces according to the programme an output signal indicative of a desired value of an electrical current to be supplied to said electromagnetic pump, a current controller which receives the output signal and which controls the electrical current in accordance therewith, a current sensor which measures a momentary RMS-value of the electrical current and which supplies a corresponding current signal to said current controller such that said current controller regulates the electrical current to minimize a difference between the output signal and the current signal.

* * * * *